United States Patent [19]

Abbey

[11] Patent Number: 4,530,805

[45] Date of Patent: Jul. 23, 1985

[54] FLOW REGULATING CARBURETORS

[76] Inventor: Harold G. Abbey, 11 Goldsmith Dr., Holmdel, N.J. 07733

[21] Appl. No.: 607,163

[22] Filed: May 4, 1984

Related U.S. Application Data

[63] Continuation of Ser. No. 379,431, May 18, 1982, abandoned, which is a continuation-in-part of Ser. No. 307,956, Oct. 20, 1981, Pat. No. 4,387,685, which is a continuation-in-part of Ser. No. 214,626, Dec. 10, 1980, Pat. No. 4,308,835.

[51] Int. Cl.[3] ..... F02M 9/08

[52] U.S. Cl. ..... 261/53; 261/DIG. 56; 261/64 E; 261/23 A

[58] Field of Search ..... 261/DIG. 56, 62, 44 F, 261/53

[56] References Cited

U.S. PATENT DOCUMENTS

| | | | |
|---|---|---|---|
| Re. 13,903 | 4/1915 | Shipman | 261/62 |
| 791,447 | 6/1905 | Breath | 261/62 |
| 928,828 | 7/1909 | Winton | 261/53 |
| 973,877 | 10/1910 | Pierce | 261/53 |
| 1,052,051 | 2/1913 | Grimes | 261/53 |
| 1,067,351 | 7/1913 | Lavigne | 261/53 |
| 1,254,735 | 1/1918 | Shipman | 261/53 |
| 1,450,762 | 4/1923 | Summers | 261/44 F |
| 2,007,337 | 7/1935 | Mallory | 261/DIG. 56 |
| 2,084,489 | 6/1937 | Hess | 261/DIG. 56 |
| 2,333,030 | 10/1943 | Meyer | 261/DIG. 56 |
| 3,937,768 | 2/1976 | Bier et al. | 261/DIG. 56 |

FOREIGN PATENT DOCUMENTS

| | | | |
|---|---|---|---|
| 520712 | 6/1921 | France | 261/62 |
| 6685 | of 1906 | United Kingdom | 261/62 |
| 2037893 | 7/1980 | United Kingdom | 261/DIG. 56 |

*Primary Examiner*—Tim Miles

*Attorney, Agent, or Firm*—Michael Ebert

[57] ABSTRACT

A flow regulating carburetor having a movable control element operating within the throat of a venturi air passage, the element being automatically displaced to vary the effective size of the throat as a function of the mass-volume of the air stream flowing through the passage. This produces a velocity-pressure differential acting automatically to regulate the quantity of fuel induced through a fuel tube communicating with the throat and intermingling with the air stream to provide a ratio of air-to-fuel representing the optimum value for the prevailing condition of engine speed and load throughout the entire engine operating range, thereby effecting a marked improvement in fuel economy and reducing the emission of pollutants.

5 Claims, 12 Drawing Figures

FLOW REGULATING CARBURETORS

RELATED APPLICATIONS

This application is a continuation of my copending application Ser. No. 379,431, filed May 18, 1982, now abandoned, which is a continuation in part (C-I-P) of my copending application (A) Ser. No. 307,956, filed Oct. 20, 1981, entitled "Fluidic Control System Including Variable Venturi" (now U.S. Pat. No. 4,387,685), which in turn is a C-I-P of my earlier patent application (B) Ser. No. 214,626, filed Dec. 10, 1980, entitled "Closed-Looop Fluidic Control System for Internal Combustion Engine" (now U.S. Pat. No. 4,308,835), which in turn is related to still earlier-filed patent applications identified therein. The entire disclosures of my related applications are incorporated herein by reference.

BACKGROUND OF INVENTION

This invention relates generally to carburetors for internal combustion engines, and more particularly to a flow-regulating carburetor having a movable valve element which is automatically shifted as a function of the mass-volume of the fluids passing through the structure.

A carburetor in accordance with the invention is especially applicable to internal combustion motorcycle and other small automobile engines to so proportion the ratio of combustion air to fuel as to maintain an optimum ratio thereof under varying conditions of load and speed throughout a wide operating range, thereby attaining higher combustion efficiency, significantly increased fuel economy and reduced emission of pollutants.

The function of a carburetor is to produce the fuel-air mixture needed for the operation of an internal combustion engine. In the carburetor, fuel is introduced in the form of tiny droplets in a stream of air, the droplets being vaporized as a result of heat absorption in a reduced pressure zone on the way to the combustion chamber whereby the mixture is rendered inflammable. In a conventional carburetor, air flows into the carburetor through a Venturi tube and a fuel nozzle within a booster Venturi concentric with the main Venturi tube. The reduction in pressure at the Venturi throat causes fuel to flow from a float chamber in which the fuel is stored through a fuel jet into the air stream. The fuel is atomized because of the difference between air and fuel velocities.

In conventional carburetors, the dispersion and vaporization effects resulting from the reduction in throat pressure prevail only during a small part of the operating range of the engine due to the fixed dimensions of the venturi which are usually chosen for midrange performances; hence one must provide idle and slow speed jets from passages and parts at or about the throttle plate to maintain fuel flow at low air flow conditions when Venturi vacuum is insufficient to draw fuel into the Venturi nozzle.

In most modern motorcycles, including the Honda, the Suzuki and Yamaha models manufactured in Japan as well as those made by British, Italian, German and by other manufacturers, use is made of "slide valve" carburetors. While these differ in detail according to the make of the machine, they are all quite similar in outward appearance and in operation. Slide-valve carburetors fall into three distinct classes: the direct-control or DC type, the CV (constant velocity or vacuum) type, and the throttle-plate type.

In the DC-type, the slide valve is laterally inserted into the air flow passage of the carburetor and moves more or less therein to vary the volume of air flow as a throttle, this movement being under the direct control of the operator by means of a cable or similar linkage. The throttle slide is the chief metering component of the carburetor and determines the volume of fuel induced into the air passage.

On the CV unit, the throttle cable directly opens and closes a throttle plate, whereas the slide proper is caused to open and close in response to venturi vacuum. The moving slide adjusts the size of the venturi throat and therefore functions to proportion the ratio of fuel to air throughout most of the operating range. Attached to the slide is a tapered jet needle which is inserted in the fuel orifice to vary the amount of fuel allowed to pass into the engine, this action occurring primarily in the mid range.

Falling into the CV category is the Motor-Craft Ford VV 2700 carburetor, a double square slide-block venturi arrangement for two barrel applications. Both slide blocks have tapered needle fuel orifices and are controlled by a common vacuum motor.

In CV carburetor operation, the fuel-to-air ratio is varied as a function of the vacuum prevailing between the throttle and throat. Inasmuch as the "control" vacuum is not linearly proportional to air flow throughout the full operating range, for satisfactory performance it is necessary to include empirically-designed needle valve tapers and air jets as well as idle, slow speed, power and pump jets to establish and acceptable relationship between air and fuel throughout the full range.

In the throttle-plate carburetor, as the name implies, use is made of a pivoted plate in the throat of the main Venturi air passage, which plate combines the functions of air valve and throttle. The action is similar to the direct control type; hence to effect the necessary corrections, idle and low speed jets, mid-range and high speed jets as well as accelerating pump jets actuated by the throttle slide or pivote plate linkage are required.

Although all present types of slide-valve carburetors adjust their throat areas, the velocity-pressures attained at the low end are insufficient to draw fuel from the main jet ports or orifices, or needle-valve jets; hence auxiliary parts and jets are required for idle and slow speeds. Furthermore, they are designed to hold constant vacuum or constant velocity in the throat section, thereby relying on the position of the slide valve and its attached tapered needle valve position in the stationary orifice to control, fuel quantity above idle and slow speeds.

The serious deficiency common to all existing types of slide-valve carburetors is their inability to provide a fuel-to-air ratio appropriate to the varying conditions which prevail throughout the full range of engine operation. While auxiliary devices and other expedients have been used to overcome this deficiency, these not only render the carburetor structure relatively complex and more expensive to manufacture and to maintain, but they fall short of providing efficient and trouble-free carburetion throughout the full range.

In my copending application (A), there is disclosed a self-regulating automatic variable venturi carburetor for supplying a fuel-air mixture to the intake manifold of an internal combustion engine in a ratio appropriate to the prevailing conditions of engine speed and load throughout a wide operating range without the need for auxiliary devices and expedients. The structure includes a spring-biased axially-shiftable spool whose contoured inner surface has a venturi configuration to define a passage through which flows incoming air intermingled with fuel drawn or injected therein.

The axial position of the spool in relation to a stationary throat line in the main venturi passage determines the area of opening at the effective throat, this opening determining the magnitude of velocity-pressure. This spool is subjected to the hydrodynamic force produced by the air-fuel mixture flowing therethrough, this force acting against the spring to displace the spool to an extent producing an effective throat opening which results in a fuel-air ratio appropriate to the prevailing condition. The present invention also exploits the hydrodynamic force to operate an air valve in an automatic carburetor.

SUMMARY OF INVENTION

In view of the foregoing, the main object of this invention is to provide a flow regulating carburetor whose movable valve element is automatically displaced as a function of the mass volume of the air stream passing through the structure to produce a velocity-pressure differential that acts to regulate the quantity of fuel induced into and intermingled with the air stream.

More particularly, an object of this invention is to provide a valved venturi carburetor whose movable valve element is so shaped and force-balanced that its reaction to air flow results in a stoichiometric or other ratio of air-to-fuel that represents the optimum value for the prevailing condition of engine speed and load throughout a broad operating range, thereby effecting a marked improvement in fuel economy and substantially reducing emission of noxious pollutants.

A salient advantage of a carburetor in accordance with the invention as distinguished from existing slide-throttle carburetors which entail auxiliary devices and other expedients to correct for the lack of proper carburetion at idle and slow speeds and other regions in the operating range, is that the valved venturi carburetor entails no such auxilary expedients, yet affords the optimum air-fuel ratio for the full range of conditions encountered in operating a vehicle. While the invention has particular value in the context of motorcycle engines, it is applicable to other forms of internal combustion engines whether used in vehicles or to drive other mechanisms.

Also an object of the invention is to provide a flow regulating carburetor constituted by relatively simple and durable components that can be maintained and readily repaired or replaced both in the shop and in the field by personnel having ordinary mechanical skills, the carburetor lending itself to low-cost mass production.

Briefly stated, these objects are attained in a valved venturi carburetor having a movable valve element operating within the throat of a venturi air passage, the element being automatically displaced to vary the effective size of the throat as a function of the mass-volume of the air stream flowing through the passage. This produces a velocity-pressure differential acting to regulate the quantity of fuel induced through a fuel tube communicating with the throat and intermingling with the air stream to provide a stoichiometric or other ratio of air-to-fuel representing the optimum value for the prevailing condition of engine speed and load throughout the entire operating range, thereby effecting a marked improvement in fuel economy and reducing the emission of pollutants.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

First Embodiment

Figure 2:
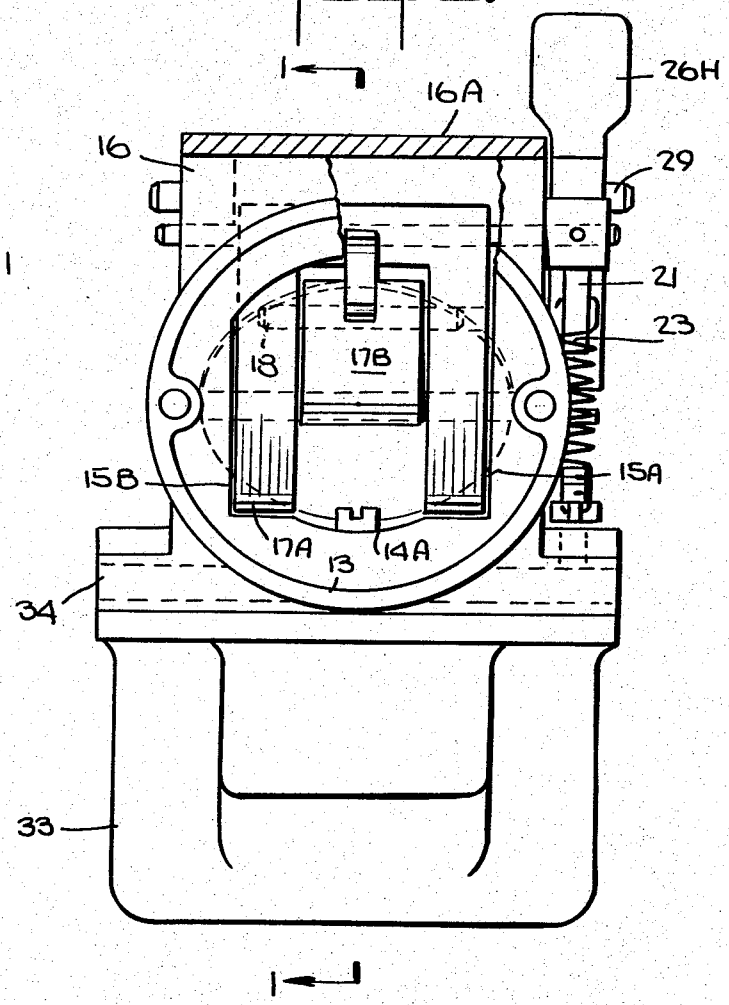
FIG. 2 is an input end view of the carburetor.
Figure 1:
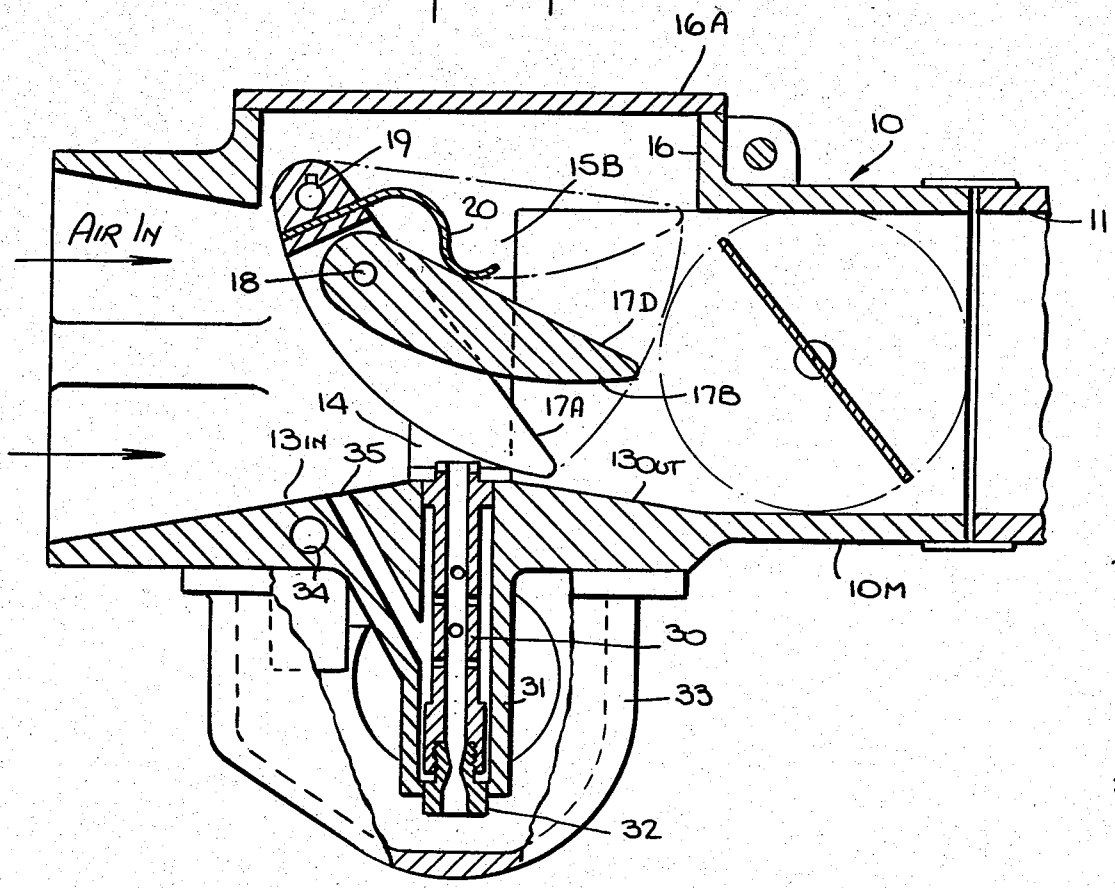
FIG. 1 is a longitudinal section taken through a first embodiment of a valved venturi carburetor in accordance with the invention.
Figure 3:
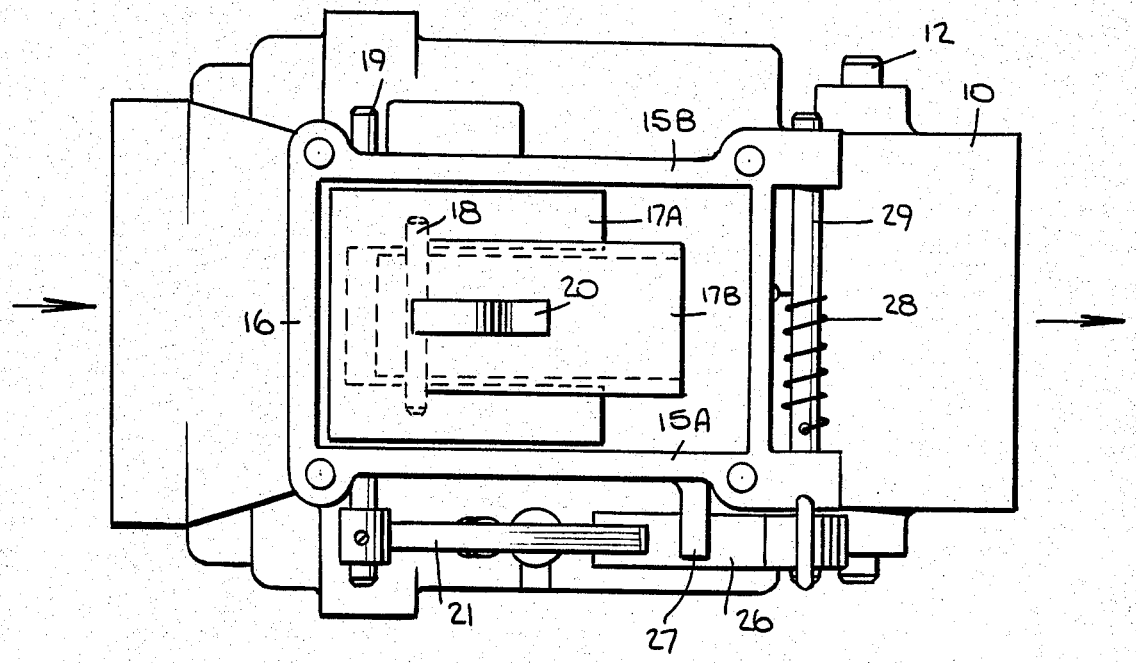
FIG. 3 is a top view thereof.
Figure 4:
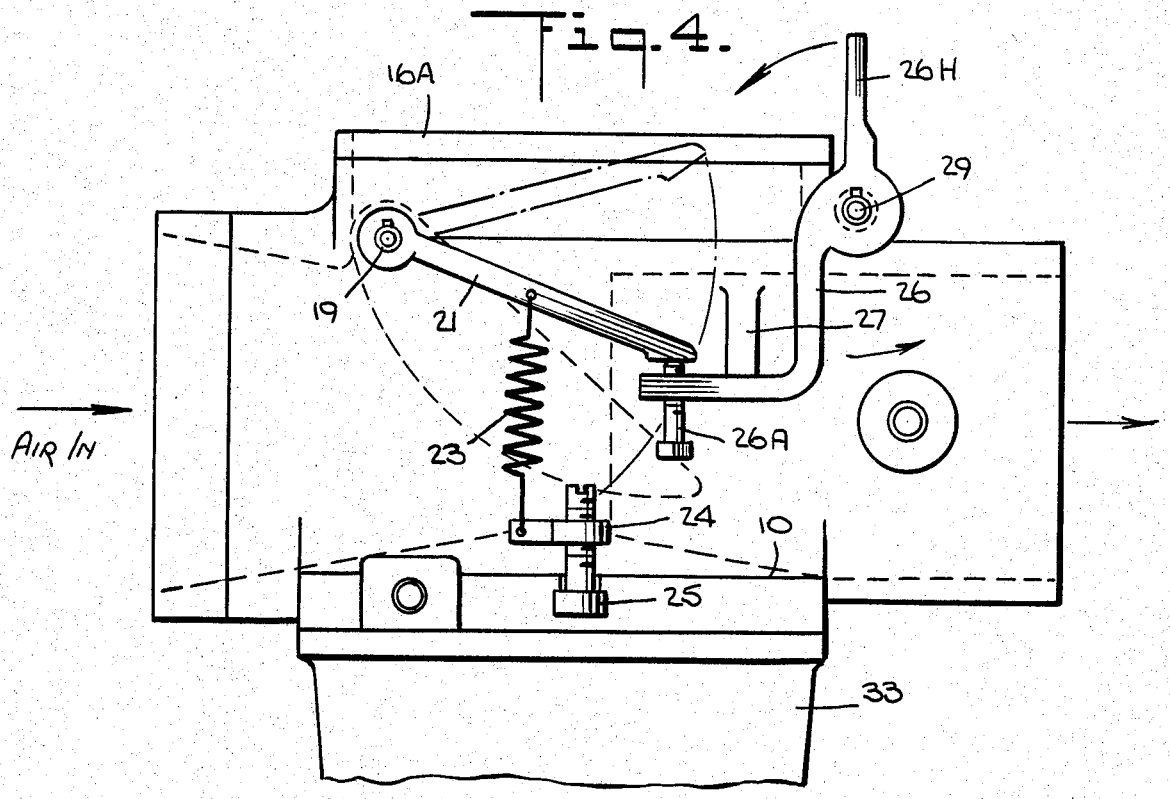
FIG. 4 is a side view of the carburetor.

Referring now to FIGS. 1 to 4, there is illustrated a flow regulating carburetor in accordance with the invention, the carburetor including a tubular venturi casing 10 through which air is caused to flow toward the intake manifold 11 of an internal combustion engine, the stream of air being intermingled with fuel to provide a combustible mixture having the desired air-fuel ratio.

In advance of intake manifold 11 in a mixing chamber 10M is an operator-controlled throttle 12 which serves to vary the volume of the incoming air-fuel mixture. The venturi tube is in classical form, it being provided with a converging inlet section **13*in* leading into a constricted throat 14 followed by a diverging outlet 13*out***.

Throat 14 of the venturi is further restricted by a pair of flat parallel walls 15A and 15B symmetrically disposed on either side of the longitudinal flow axis. Walls 15A and 15B extend upwardly from the arcuate base 14A of throat 14 to join a box-like extension 16 on casing 10. This extension is sealed by a cover plate 16A.

Operating within extension 16 in the chamber defined by parallel walls 15A and 15B is a composite valve element constituted by a bifurcated outer part 17A between whose legs is a solid inner part 17B. Outer part 17A is pivotally mounted within the casing by a shaft 19 keyed thereto, whereas inner part 17B is hinged from outer part 17A by a hinge pin 18. Shaft 19 extends across casing 16 along a transverse axis upstream of throat 14, so that part 17A is free to swing in the chamber, while part 17B is free to swing with respect to part 17A. The downstream surface of part 17B is provided with strips 17C and 17D on both sides overlapping the parallel side walls of part 17B and the inner wall of part 17A to provide a "stop" and seal in the aligned position.

The side walls of inner and outer parts 17A and 17B are all flat and parallel to walls 15A and 15B to effectively block the throat when part 17A is at its lowermost position and part 17B is aligned therewith to close the gap between the legs of part 17A. There is sufficient clearance between the side walls of these parts and the surfaces of walls 15A and 15B to allow for free movement of the parts.

The upstream faces of valve parts 17A and 17B are so contoured that when they are aligned and swing together upwardly from their lowermost position, they create a venturi passage of varying cross section in conjunction with the stationary venturi casing, and create in all such positions a streamlined convergence toward throat 14 and a gradual divergence therefrom. The downstream faces of the valve parts are shown as flat, but this form is not critical and may assume other configurations.

Inner valve part 17B is constrained by a leaf spring 20 anchored on outer part 17A, this spring urging inner part 17B into alignment with outer part 17A to close the gap between the legs thereof. An external lever 21 is secured to one end of shaft 19 on which outer part 17A is hinged. Lever 21 is linked at about its midpoint to a helical tension spring 23 anchored on a threaded collar 24. Collar 24 is seated on a rotatable set screw 25 held in a slot in the wall of casing 10. Thus by turning the screw in the appropriate direction, one can either raise or decrease the spring tension on the lever. The tension of spring 23 acts to urge valve part 17A toward its closed or minimum idle position.

Also provided is an L-shaped choke lever 26 secured to a pivot shaft 29 mounted on the casing, the free end of this lever having a screw 26A passing through a threaded bore therein to engage the foot of valve tension lever 21. Upward movement of choke lever 26 is limited by a stop 27. Surrounding pivot shaft 29 (see FIG. 3) is a helical spring 28 which acts to resist rotation of the shaft when choke lever 26 is manually swung by means of its handle 26H.

The relationship of choke lever 26 to valve lever 21 is such that the choke lever normally raises the valve lever slightly above its closed valve position. When, therefore, handle 26H is operated manually counterclockwise, it permits valve lever 21 under the tension of spring 23 to close the valve fully to perform a starting choke action. The spring force of choke spring 28 is greater than the maximum spring force attainable by tension spring 23 for part 17A, which force is greater than the force of leaf spring 20 acting in part 17B.

Accordingly, by appropriate choice of the force displacement characteristics or spring rates of springs 20 and 23, the aerodynamic force of the incoming air stream impinging on the front faces of valve parts 17A and 17B will first open inner part 17B which is biased by the weaker spring 20, this part acting as the primary venturi valve. As air flow increases to a point causing maximum opening of inner valve part 17B, outer part 17A will then proceed to open, thereby contributing its throat area as the secondary air valve. Conversely, a decreasing air flow allows outer part 17A to close first and inner part 17B to then function as a variable valve from the medium operating range to idle.

The positive aerodynamic force imposed on the front face of the valve parts in combination with the negative or vacuum force applied to the rear face thereof as a result of intake vacuum, as counterpoised by the spring forces acting on these parts, gives rise to a resultant differential velocity pressure ($P_1-P_2$); i.e., the difference between pressure prevailing at the inlet to the venturi and pressure at its throat. This differential pressure is proportional to mass-volume air flow for the full operating range from idle to full speed or power.

Fuel is induced into throat 14 to an extent proportional to air flow, this being accomplished in a conventional manner. To this end, a pick-up tube is mounted at the bottom of the casing to communicate with the throat, the tube being centered with respect to the two-stage valve. Pick-up tube 30 extends into fuel tube 31 whose lower end is provided with a fixed orifice jet 32 immersed in the fuel of a standard float-bowl reservoir 33 supplied by float valve control pump inlet 34 from a fuel tank. Pick-up tube 30 is perforated so that an orifice air jet 35 in a passage leading into fuel tube 31 allows air dispersion into the liquid fuel before it is drawn into the throat to commingle with the throttle-controlled air flow.

The valve parts are readily accessible through the cover 16A of the casing extension and may be quickly replaced, if necessary.

Second Embodiment

Figure 6:
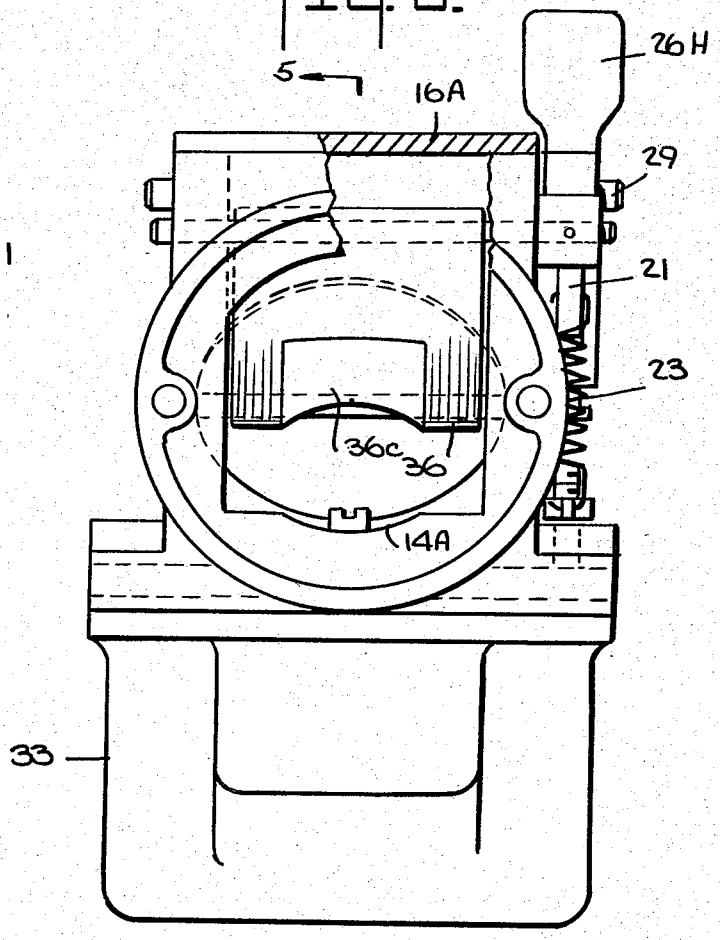
FIG. 6 is an input end view of the carburetor shown in FIG. 5.
Figure 5:
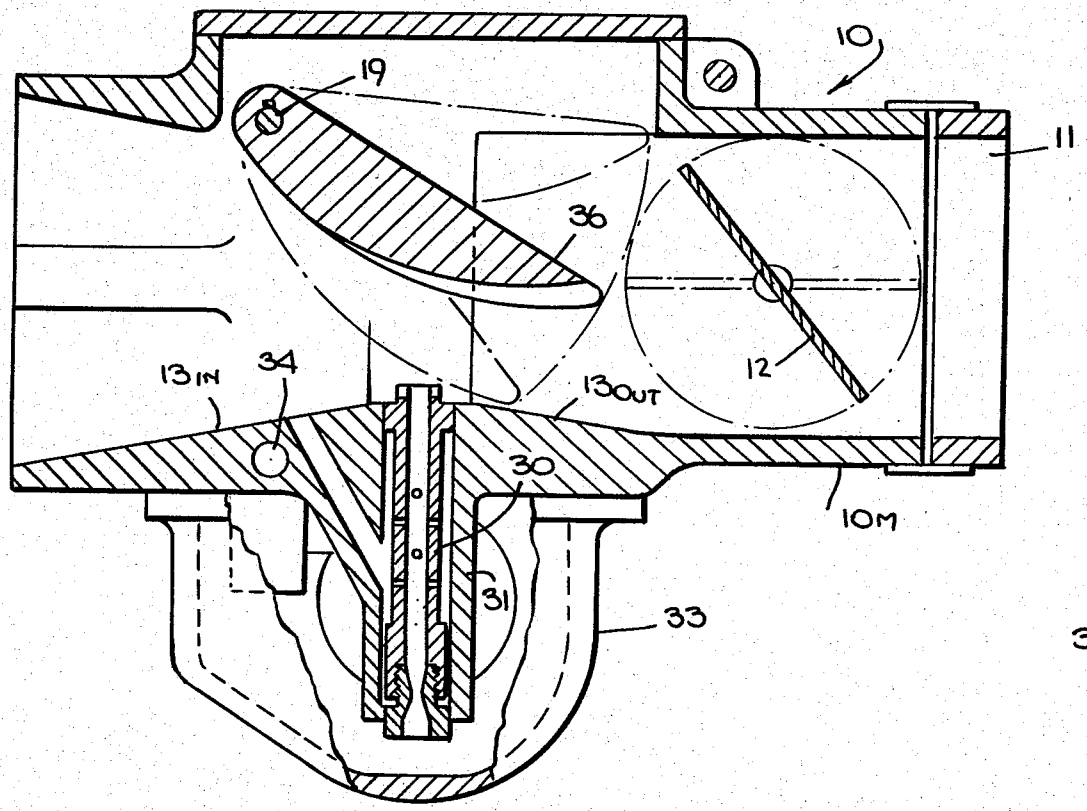
FIG. 5 is a longitudinal section taken through a second embodiment of the invention.
Figure 7:
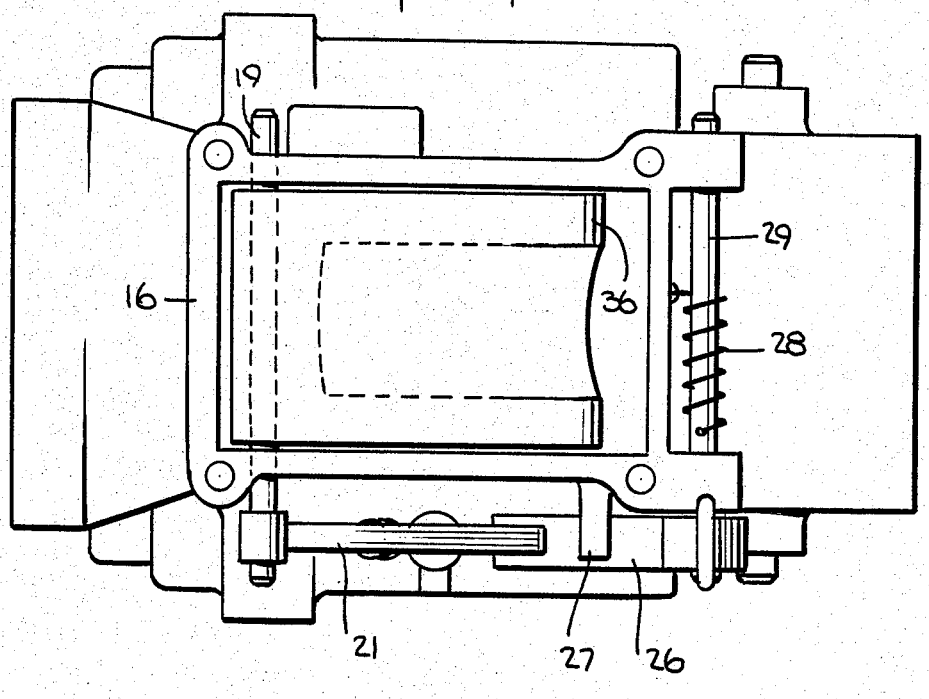
FIG. 7 is a top view of the carburetor shown in FIG. 5.

In the first embodiment, the valve in the venturi has a two-stage construction. In the second embodiment shown in FIGS. 5 to 7, the venturi carburetor structure is essentially the same, but the valve 36 pivoted on shaft 19 is a single stage element whose convexly curved upstream face has a concavity 36C therein to reduce frictional losses.

The single stage valved venturi carburetor is applicable where a small carburetor is specified. In all other respects, the operation of this carburetor is generally similar to that shown in the first embodiment.

Third Embodiment

Figure 8:
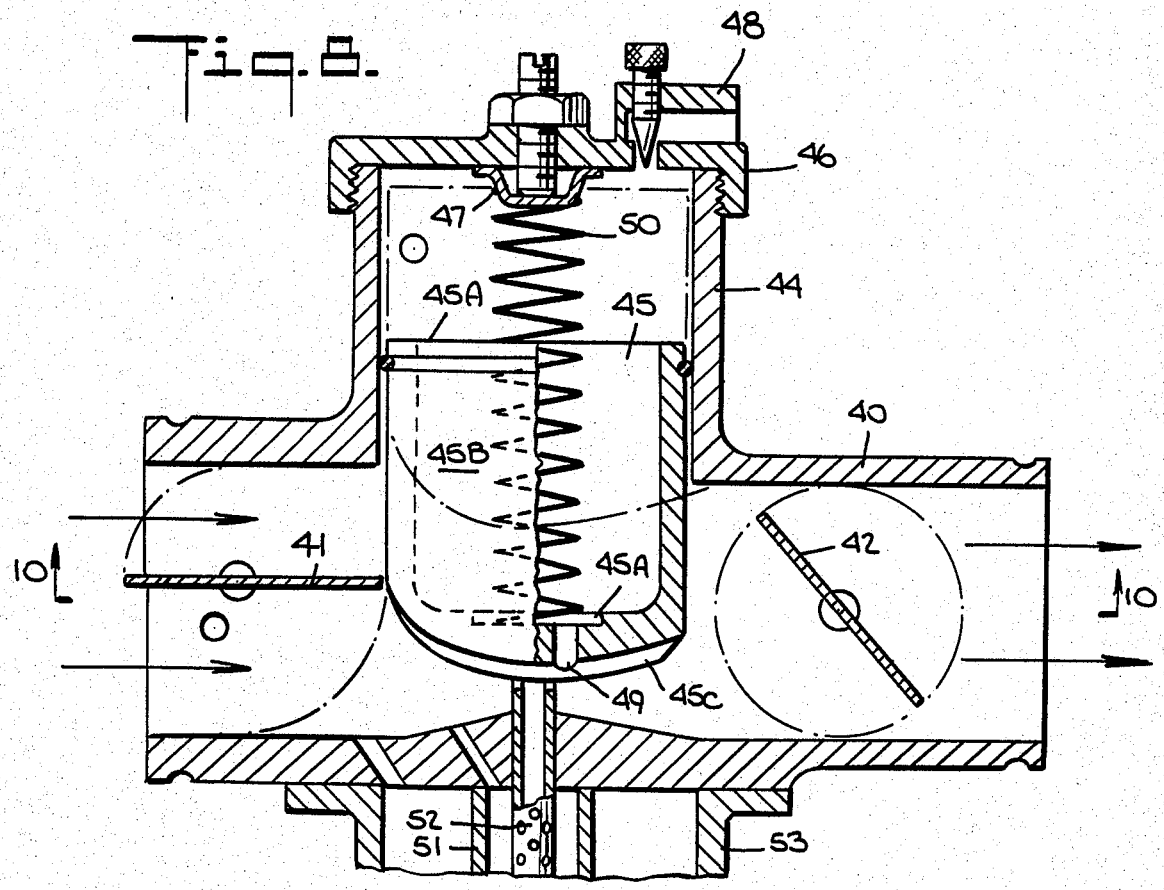
FIG. 8 is a longitudinal section taken through a third embodiment of the invention.
Figure 9:
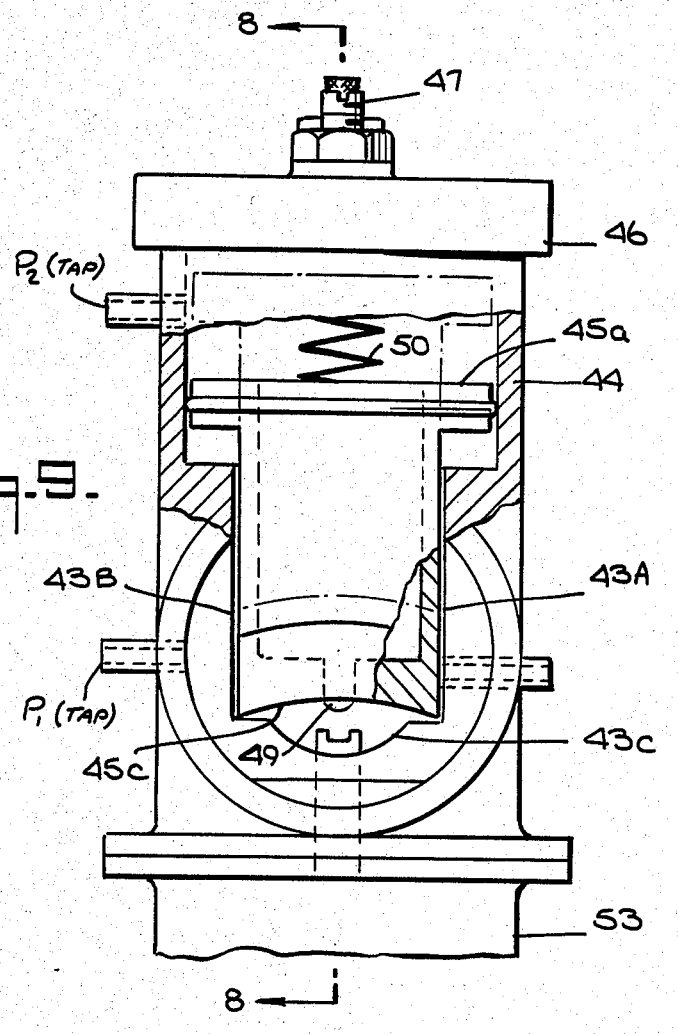
FIG. 9 is an input end view of the FIG. 8 carburetor.
Figure 10:
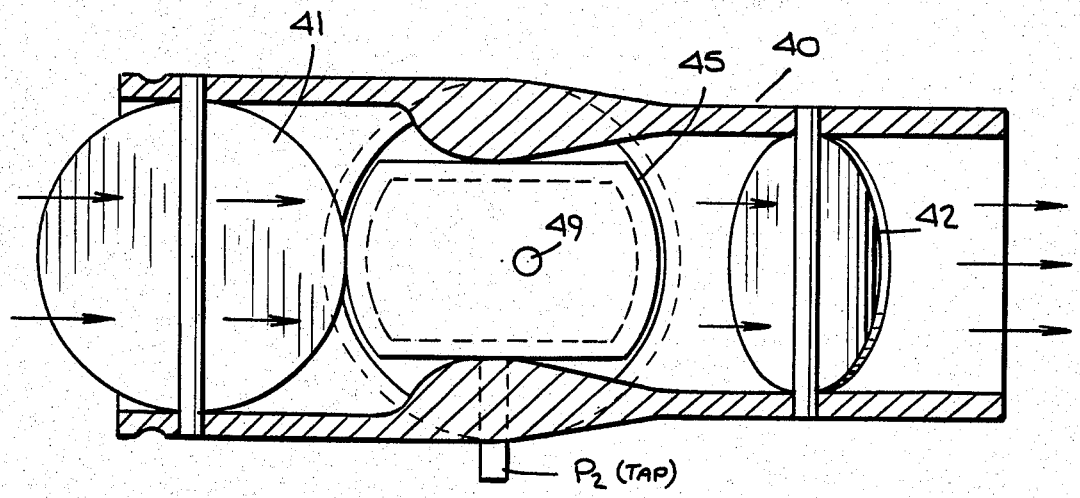
FIG. 10 is a bottom sectional view of the FIG. 8 carburetor.

In the third embodiment shown in FIGS. 8 to 10, use is made of a tubular venturi casing 40 having a choke 41 in the inlet section and a throttle 42 in the outlet leading to the intake manifold of the engine. Throat 43 is defined by parallel flat side walls 43A and 43B symmetrically disposed on either side of the longitudinal flow axis, the side walls being spaced apart a distance equal to the inscribed diameter of an equivalent circular throat. The base 43C of the throat is shown as having an arcuate form, but in practice it may be flat and be spaced from the longitudinal axis the same distance as the side walls.

Also provided is a cylindrical chimney 44 that rises above casing 40 at the throat thereof, the outer axis of the chimney being normal to the longitudinal axis of the venturi passage in the casing. Received within chimney 44 and projecting into the throat diameter defined by side walls 43A and 43B is a slide valve 45 consisting of an upper circular head 45A that slidably fits into chimney 44 and a main body 45 in the form of a symmetrically-flattened cylinder that slidably fits into the like shaped throat chamber defined by side walls 43A and 43B.

The undersurface 45C of valve body 45B is concave across the throat and curved in the axial direction of flow, whereby in conjunction with base 43C of the throat, it forms a venturi-like passage.

In all laterally-adjustable positions of valve 45, the valve provides a converging inlet passage leading to a constricted opening that is followed by a diverging outlet passage to create a Venturi effect resulting in velocity-pressure conversion. Chimney 44 is closed by a screw cap 46 provided with an adjustable spring retainer 47 and an adjustable air bleed 48. The throat chamber in which valve 45 operates is in communication with the variable throat passage by means of an opening 49 in the bottom of valve 45.

A compression spring 50 is interposed between the head 45A of the valve and retainer 47, the spring urging the valve to a minimum opening venturi passage. As in the previous embodiment, the positive aerodynamic force imposed on the upstream face of the valve body in combination with the negative vacuum force acting on the downstream face thereof are counterpoised by spring 50, providing a differential velocity-pressure in the varying throat orifice that is proportional to the mass-volume air flow over the entire range of engine operation.

In this valved venturi carburetor arrangement, fuel is induced into the throat, use being made for this purpose of a fuel nozzle 51 and a pick-up tube 52, with an orifice jet in the fuel tube of a conventional float bowl reservoir 53, as in the previous embodiments.

Fourth Embodiment

Figure 11:
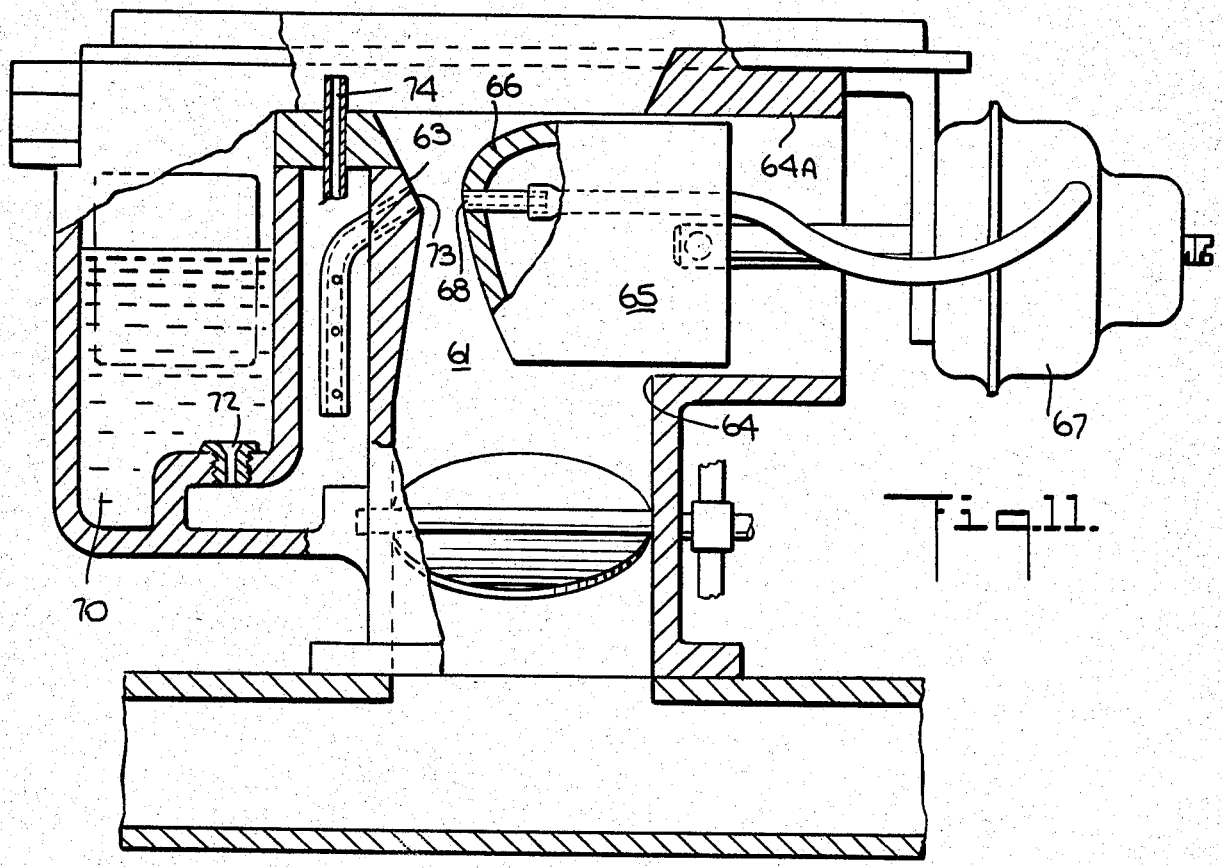
FIG. 11 is a section taken through a fourth embodiment of a valved-venturi carburetor.
Figure 12:
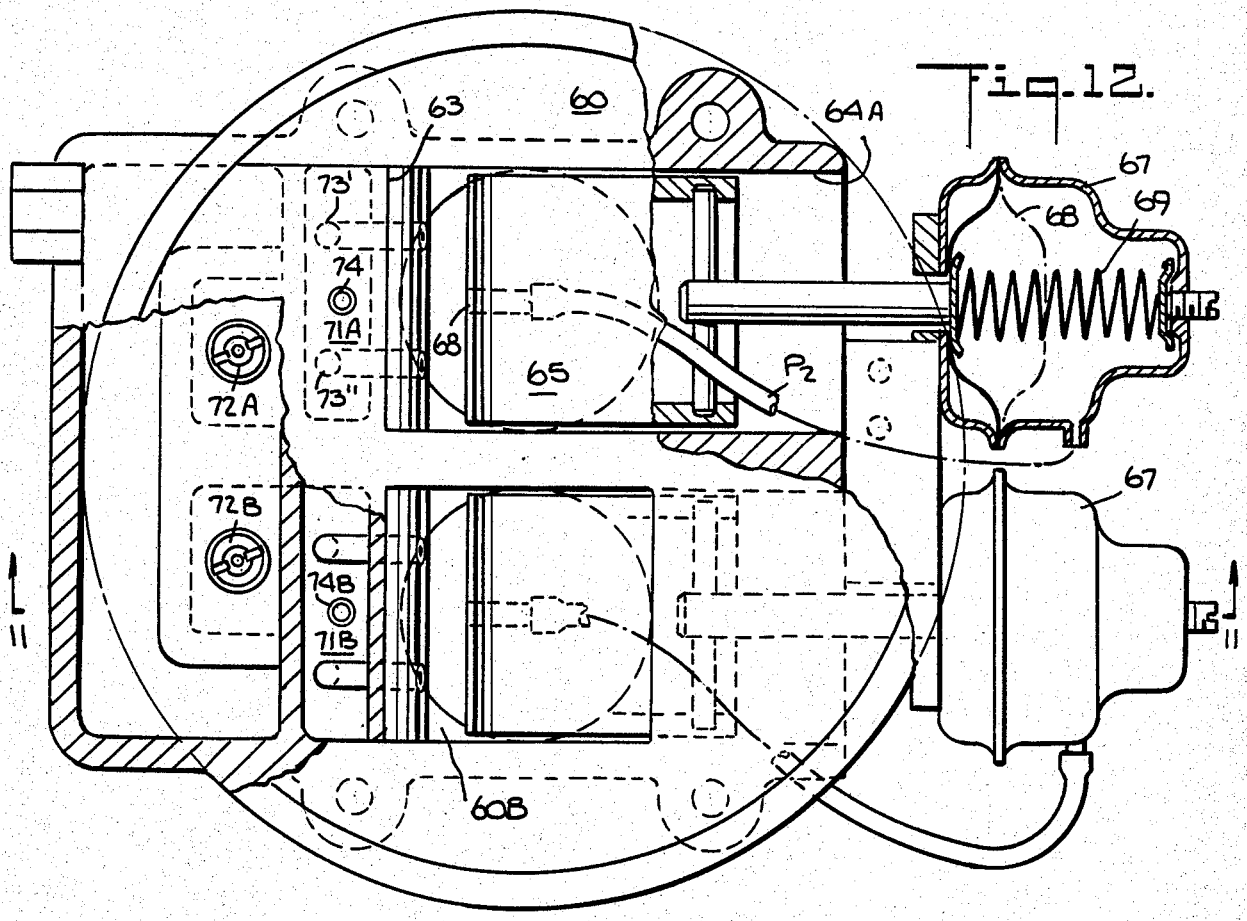
FIG. 12 is a top view thereof.

This embodiment of the invention as shown in FIGS. 11 and 12 consists of a slide block type of venturi-valve structure that achieves the wide range of velocity-pressure values in its throat to control air-fuel ratio with high dispersion and vaporization effectiveness throughout the operational range without the additional expedients conventionally required for this purpose. The distinguishing feature of this embodiment is the inclusion of a unitary spring-return vacuum motor coupled to the movable valve element.

This embodiment is a two-barrel version that is essentially a dual one-barrel arrangement with the added advantage of being usable either in tandem or "progressively."

Casing 60 consists of two "square" passages 60A and 60B each with two parallel sides 61 and 62. One side 63 is "venturi" contoured and the fourth side is an opening 64 opposite side 63 for the venturi shaped slide-block valve 65. Opening 64 extends into a rectangular casing 64A which serves as guides for the four sides of the valve-block 65 slidably fitted therein.

The front side 66 of valve-block 65, projecting into the air passage, is venturi-shaped opposite to stationary wall 63 whereby in all laterally-shifted positions between wall 63 and valve-block front 66, a variable venturi-passage is formed comprised of a converging part leading to a narrow throat, and then a diverging part connecting to a throttle chamber and thence to the engine intake manifold.

Venturi-valve block 65 is coupled to the shaft of vacuum motor 67. A tap 68 in the center throat of valve block front 66 is flexibly ducted to the vacuum chamber 68 of motor 67. Vacuum diaphragm and connected shaft of the motor is compression spring biased to extend the shaft and connected valve-block 65 to its limit at or near wall 63 forming the minimum cross-sectional size of the venturi passage.

Adjacent side wall 63, there is provided a conventional float-bowl fuel reservoir assembly 70 common to both "barrels." This common reservoir is divided into two fuel chambers 17A and 71B each adjacent to the respective passage wall 63, each containing a fixed orifice jet 72A and 72B between fuel reservoir 70 and their respective fuel chambers 71A and 71B.

Each fuel chamber contains two fuel pick-up tube nozzles 73' and 73'' leading therefrom into each throat of the venturi-valve passage. Whereas one needle-valve orifice is the norm due to fuel equalization difficulties in such systems, two or more equal sized tube-nozzles in this invention provides better fuel distribution in the elongated throats of "rectangular" venturis without equalization or control difficulties. Each fuel chamber is provided with an air induction tube-jet 74A and 74B which allows primary air to commingle with fuel as it is drawn into the throat of the venturi-valve aiding dispersion and vaporization.

While there have been shown and described preferred embodiments of valved venturi carburetors in accordance with the invention, it will be appreciated that many changes and modifications may be made therein without, however, departing from the essential spirit thereof.

I claim:

1. A flow regulating carburetor interposable between the combustion air input and the intake of an internal combustion engine which in operation has an air flow proportional to the speed and load of the engine, the air flow giving rise to a proportional fuel flow, said carburetor comprising:

A. a casing having an upstream section coupled to said air input, a downstream section coupled to said engine intake and a throat intermediate said sections whereby incoming air flows through said throat into said engine intake;

B. means communicating with said throat to supply fuel thereto, which fuel is induced therein by the air flowing through the throat to an extent determined by the differential velocity-pressure developed between the air input and the throat to provide a fuel-air mixture to said engine intake;

C. a throttle interposed between said downstream section and said intake to vary the volume of said mixture fed into the intake; and D. A swingable, aerodynamic control element pivotally supported in said casing at a position therein at which the incoming air flows above and below the element to effect an aerodynamic lift thereof, said control element being swingable from a minimum to a maximum position and being counterpoised by a spring to normally maintain said control element at its minimum position at which the area at the throat is at its minimum value, said control element being contoured to cooperate with the inner surface of the casing to shape said upstream section so that it converges toward the throat and to shape the downstream section so that it diverges from the throat to form a venturi passage within the casing, said control element being subjected to the aerodynamic force of the air flowing through the casing which acts to swing the control element toward its maximum position at which the area of the throat is at its maximum value, the force imposed in said element being counterpoised by the spring to produce a differential velocity pressure at the throat that depends on the difference between the prevailing pressure at the air input and at the throat and is proportional to the mass-volume of the air flow to cause the amount of fuel induced into the throat to be proportional to said air flow and thereby give rise to a ratio of fuel to air at the engine intake that represents the optimum ratio for the prevailing condition of engine speed and load throughout a broad engine operating range.

2. A carburetor as set forth in claim 1, wherein said control element is constituted by a bifurcated outer part whose upper end is provided with a shaft which pivots the part from the casing so that it can swing to more or less open said throat, and an inner part which is pivoted from the outer part to more or less close the gap between the legs of the outer part.

3. A carburetor as set forth in claim 2, wherein said shaft has an external tension lever connected to one end thereof, to which lever a spring is coupled to provide said spring bias.

4. A carburetor as set forth in claim 3, wherein said inner part is spring biased to normally maintain the gap closed.

5. A carburetor as set forth in claim 4, further including a spring-biased choke lever which engages the tension lever and which when operated causes the tension lever to fully close the throat.

* * * * *